US006481796B1

(12) United States Patent
Chen

(10) Patent No.: US 6,481,796 B1
(45) Date of Patent: Nov. 19, 2002

(54) CHAIR HAVING A RECLINING STRUCTURE

(75) Inventor: Yuan-Chuen Chen, Chang-Hua Hsien (TW)

(73) Assignee: Hsin Hao Health Materials Co., Ltd., Chang-Hua Hsien (TW)

( * ) Notice: Subject to any disclaimer, the term of this patent is extended or adjusted under 35 U.S.C. 154(b) by 41 days.

(21) Appl. No.: 09/847,362

(22) Filed: May 3, 2001

(51) Int. Cl.[7] ..... A47C 1/024
(52) U.S. Cl. ..... 297/329; 297/88; 297/330
(58) Field of Search ..... 297/83, 84, 88, 297/322, 325, 329, 330, 344.1, 68

(56) References Cited

U.S. PATENT DOCUMENTS 3,284,134 A * 11/1966 Malitte ..... 297/329
5,145,232 A * 9/1992 Dal Monte ..... 297/330
5,603,551 A * 2/1997 Sheehan ..... 297/322
6,203,106 B1 * 3/2001 Nearing et al. ..... 297/329

* cited by examiner

*Primary Examiner*—Peter R. Brown
(74) *Attorney, Agent, or Firm*—Harrison & Egbert

(57) ABSTRACT

A reclining chair is formed of a base frame, a seat frame, and a backrest frame. The base frame is provided with two horizontal slide rails and two inclined slide rails. The seat frame is provided with two first slide wheels slidable on the horizontal slide rails, and two second slide wheels slidable on the inclined slide rails. The backrest frame is fastened at one end to the seat frame such that the backrest frame reclines along with the seat frame.

6 Claims, 9 Drawing Sheets

CHAIR HAVING A RECLINING STRUCTURE

BACKGROUND OF THE INVENTION

1. Field of the Invention

The present invention relates generally to a chair, and more particularly to a chair which has a reclining structure.

2. Description of Related Art

As shown in FIG. 1, a reclining chair of the prior art comprises a backrest 10 and a seat 11. The backrest 10 can be reclined, as illustrated in FIG. 1. The prior art reclining chair is limited in function because the backrest 10 is independently reclined, without a coordination of the seat 11. In other words, as the backrest 10 is reclined, the seat 11 remains stationary. It is uncomfortable to sit on the prior art reclining seat in the reclining state, due to the fact that the vertebral column and the thighbone of a person seated on the chair form an angle greater than 90 degrees, as illustrated in FIG. 1. In addition, the reclined backrest 10 of the prior art reclining chair takes up too much of the room space and is apt to hit a wall of the room.

BRIEF SUMMARY OF THE INVENTION

The primary objective of the present invention is to provide a reclining chair which is free of the shortcomings of the prior art reclining chair described above.

In keeping with the principle of the present invention, the foregoing objective of the present invention is attained by a reclining chair which comprises a seat frame, a backrest frame, and a driving device enabling the seat frame and the backrest frame to recline synchronously.

The features, functions, and advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
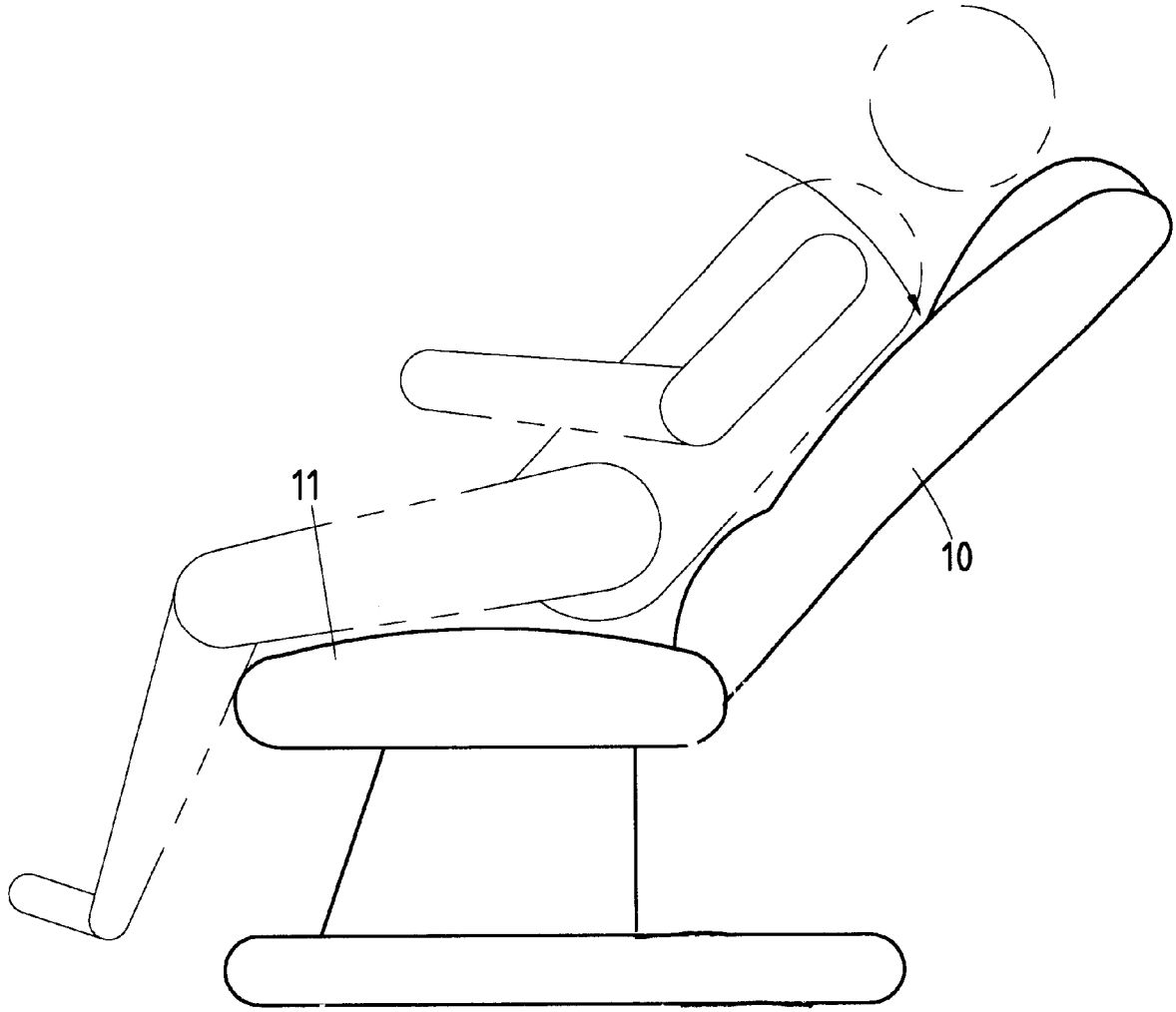
FIG.1 PRIOR ART
FIG. 1 shows a schematic view of a prior art reclining chair at work.
Figure 2:
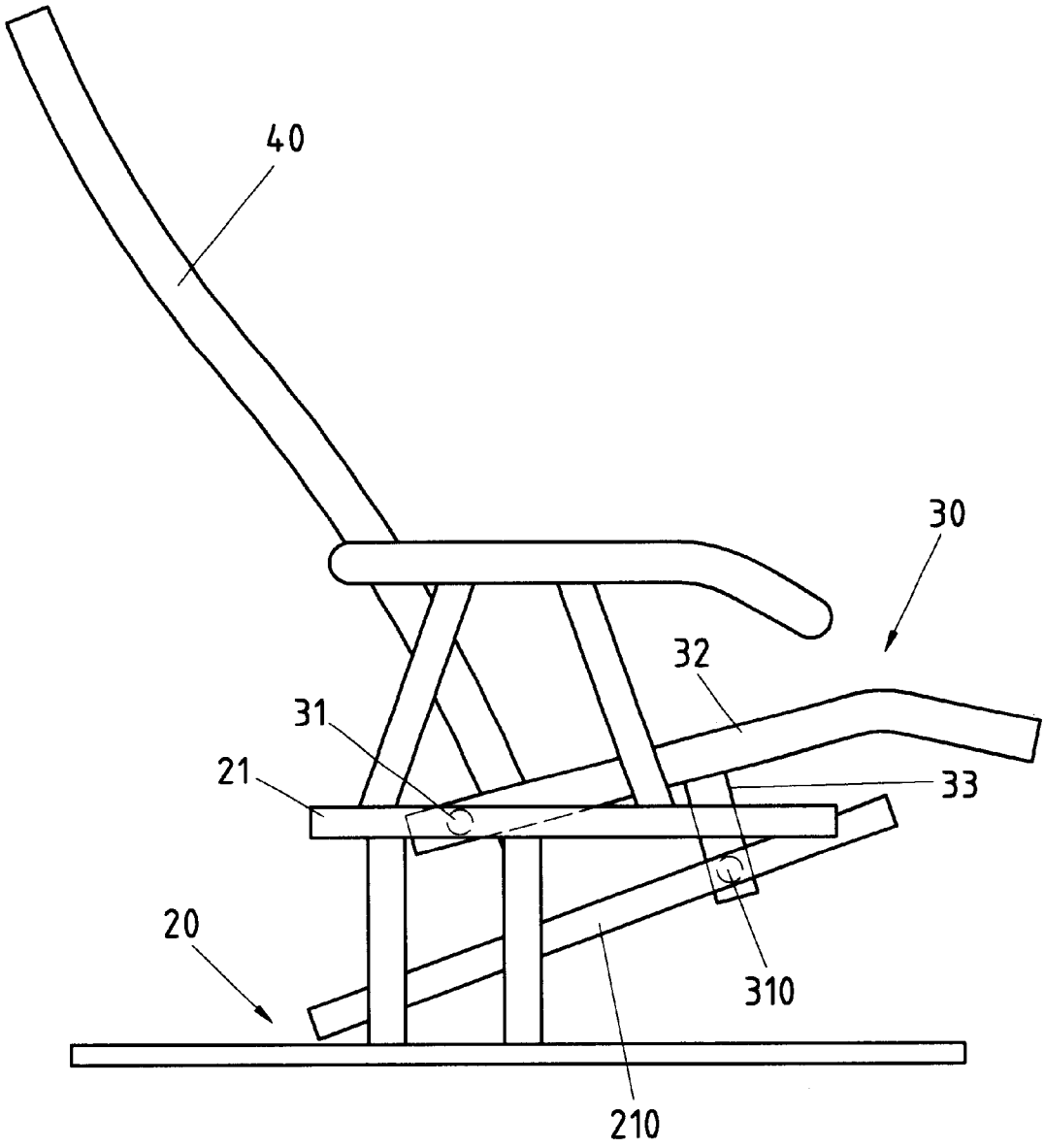
FIG. 2 shows a side schematic view of a first preferred embodiment of the present invention.
Figure 3:
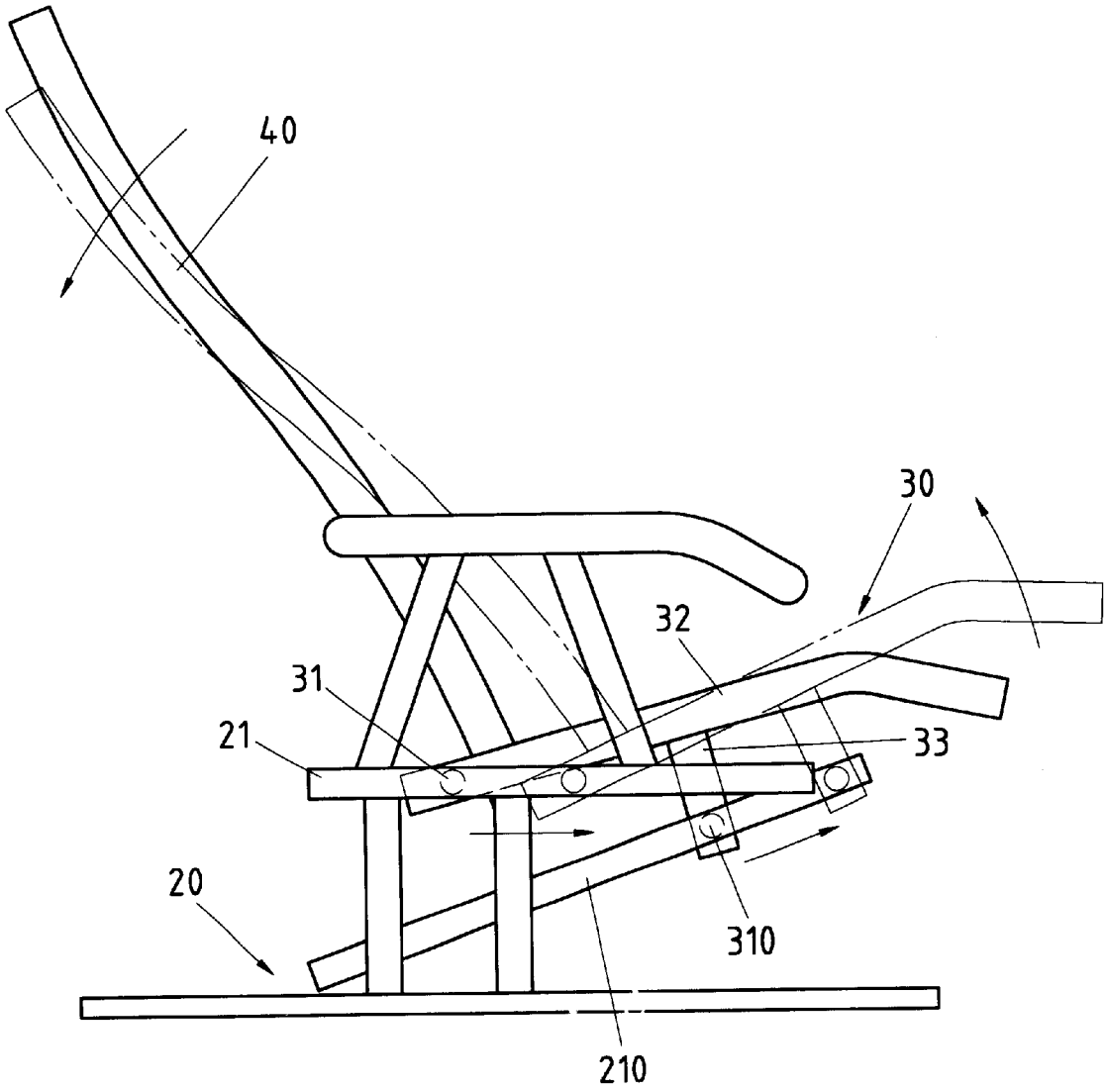
FIG. 3 shows a schematic view of the first preferred embodiment of the present invention at work.
Figure 4:
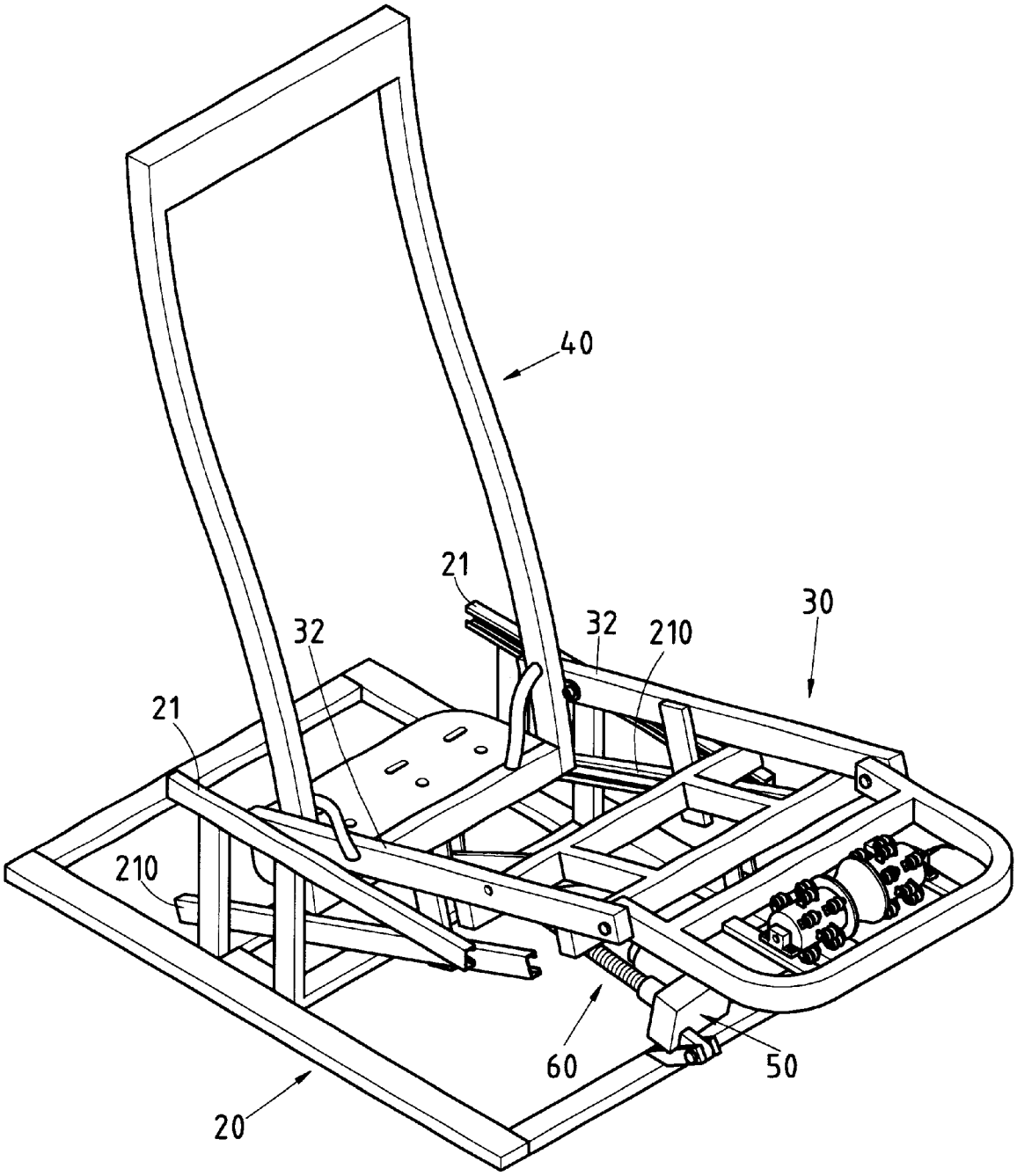
FIG. 4 shows a schematic view of a second preferred embodiment of the present invention.
Figure 5:
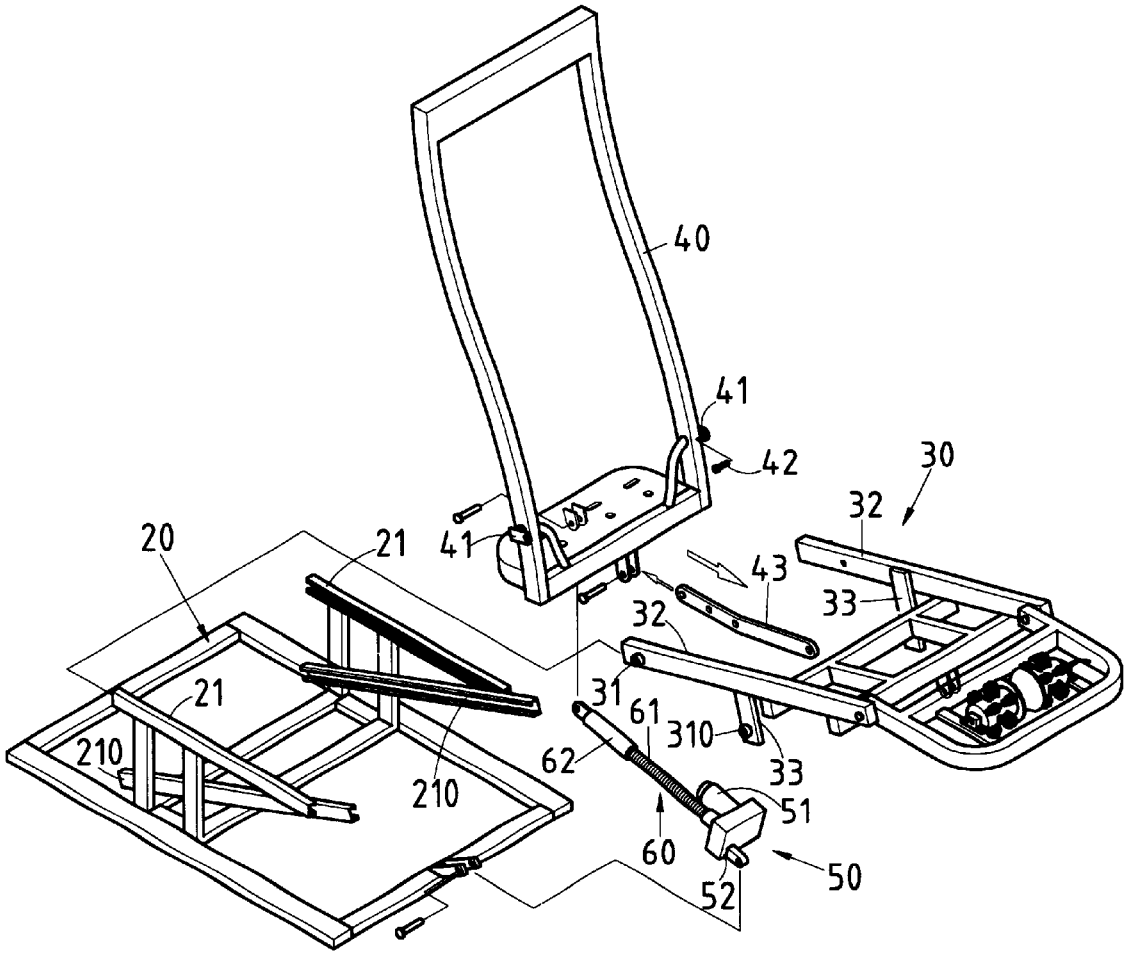
FIG. 5 shows an exploded view of the second preferred embodiment of the present invention.
Figure 6:
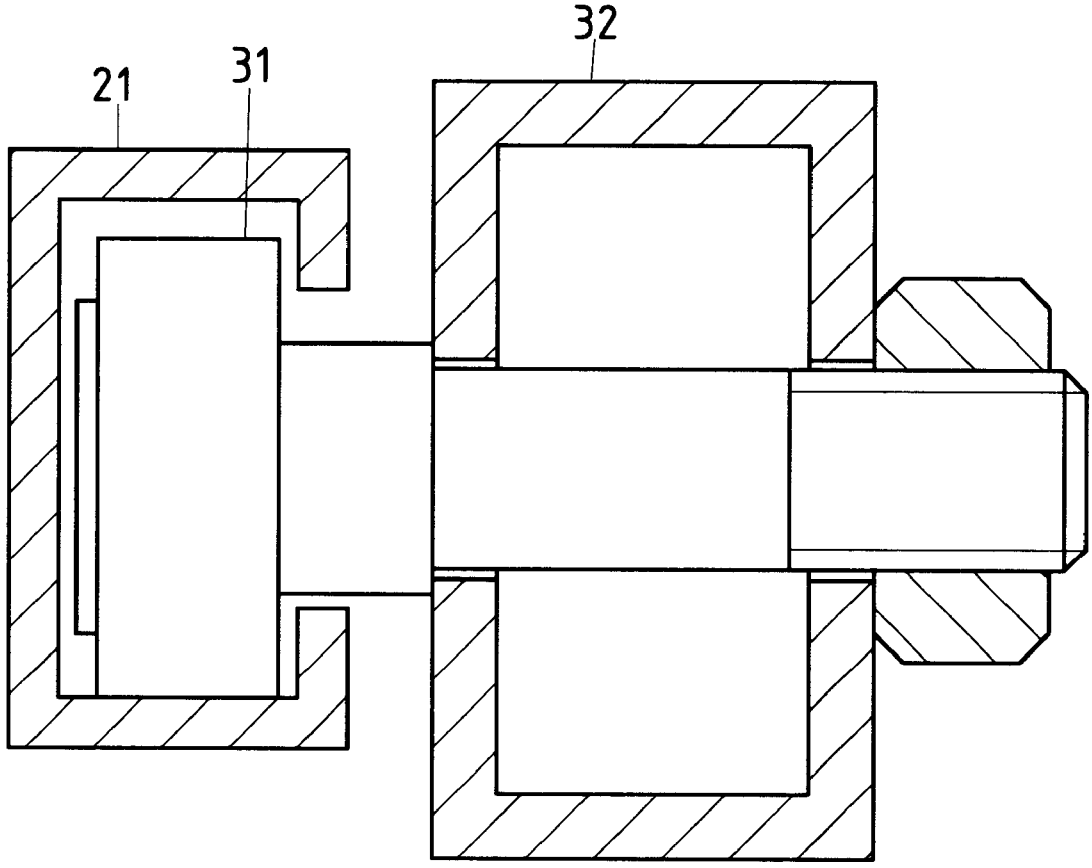
FIG. 6 shows a partial sectional view of the second preferred embodiment of the present invention.
Figure 7:
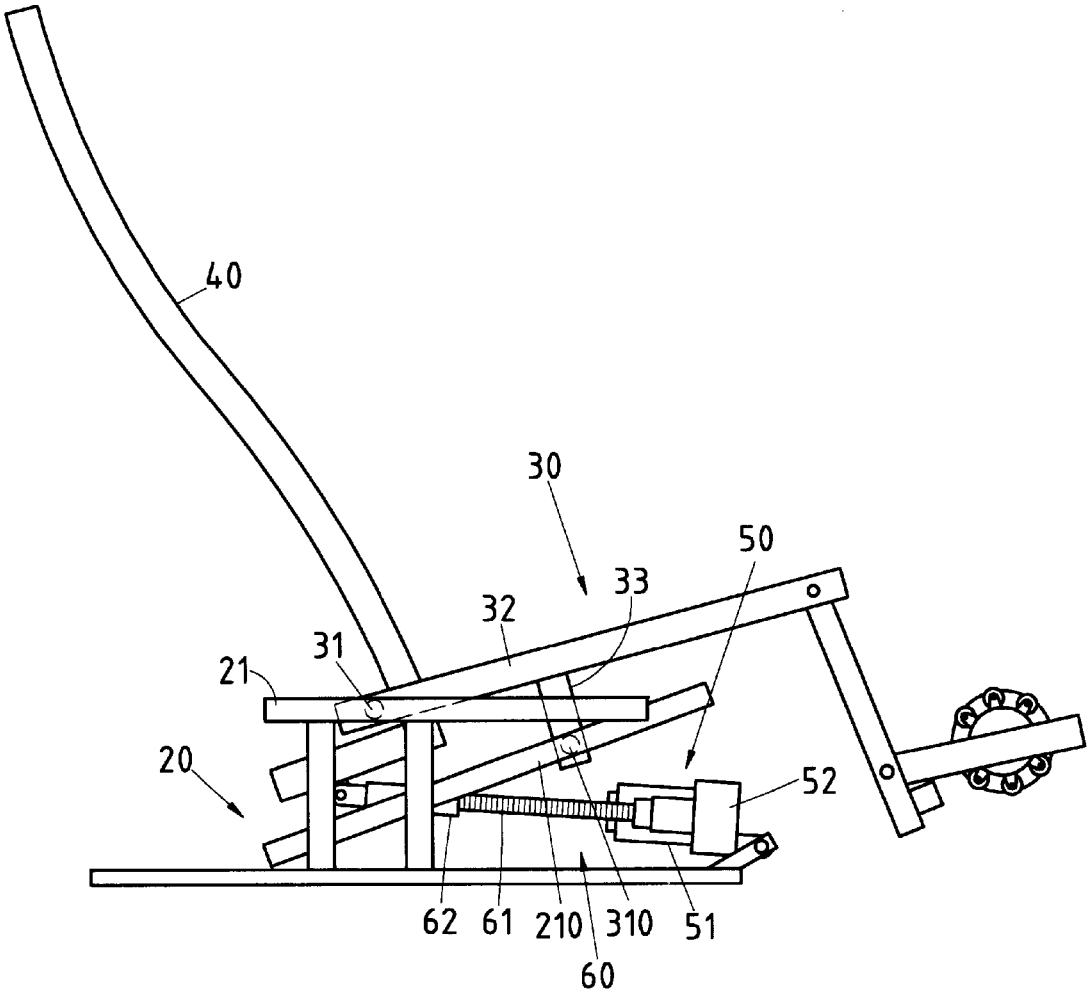
FIG. 7 shows a side schematic view of the second preferred embodiment of the present invention.
Figure 8:
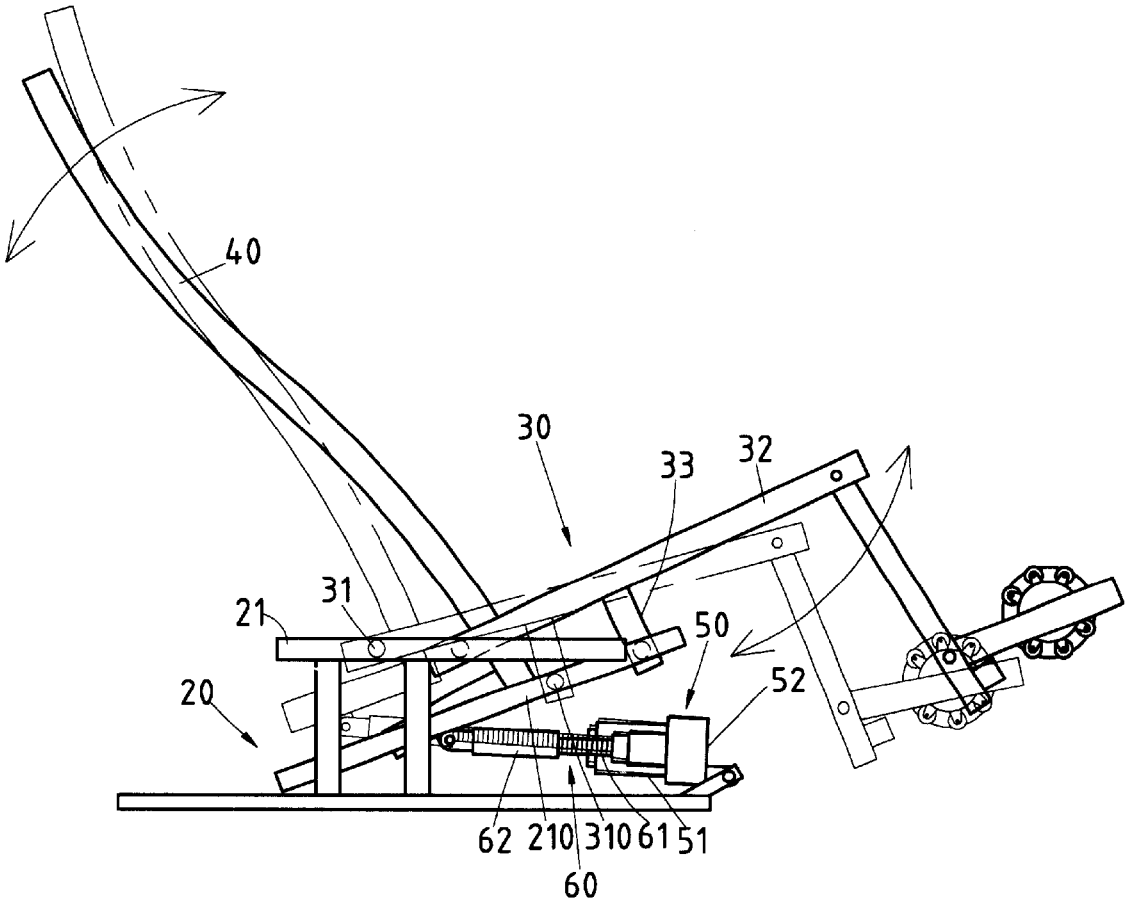
FIG. 8 shows a schematic view of the second preferred embodiment of the present invention at work.

As shown in FIGS. 1–3, a reclining chair embodied in the present invention comprises a base frame 20, a seat frame 30, and a backrest frame 40.

The base frame 20 is provided in two opposite sides of the top thereof with a horizontal slide rail 21 and is further provided under the horizontal slide rail 21 thereof with an inclined slide rail 210.

The seat frame 30 comprises two support rods 32 and two support plates 33 extending from the support rods 32. The support rods 32 are provided at the rear end with a slide wheel 31 pivoted thereto. The support plates 33 are provided at the free end with a slide wheel 310 pivoted therewith. The slide wheel 31 slides on the horizontal slide rail 21, whereas the slide wheel 310 slides on the inclined slide rail 210. As the seat fame 30 is displaced, the slide wheels 31 and 310 slide respectively and synchronously on the slide rails 21 and 210 of the base frame 20.

The backrest frame 40 is fastened to the rear end of the seat frame 30 such that the backrest frame 40 and the seat frame 30 form therebetween a predetermined angle. As the seat frame 30 is displaced forward, the backrest frame 40 reclines synchronously.

As shown in FIGS. 4–8, a reclining chair of the second preferred embodiment of the present invention comprises a base frame 20, a seat frame 30, a backrest frame 40, a drive device 50, and an expandable member 60. The drive device 50 is mounted on the base frame 20 to actuate the expandable member 60 which is disposed between the bottom of the rear end of the seat frame 30 and the base frame 20. The backrest frame 40 is provided in two sides of the bottom end with a lug 41, which is fastened to the seat frame 30 by a fastening bolt 42. In addition, the backrest frame 40 and the seat frame 30 are connected with each other by a connection body 43.

The drive device 50 is formed of a motor 51 and a transmission member 52 which is driven by the motor 51 to actuate a threaded rod 61 of the expandable member 60 as well as a threaded tube 62 which is disposed on the base frame 20 and is fitted over the threaded rod 61. As the transmission member 52 is driven by the motor 51, the threaded rod 61 is indirectly actuated to engage in the expanding action in the threaded tube 62, thereby enabling the seat frame 30 to engage in a reclining motion along with the slide wheels 310 which slide on the inclined slide rails 210. At the same time, the backrest frame 40 is linked to recline along with the seat frame 30.

Figure 9:
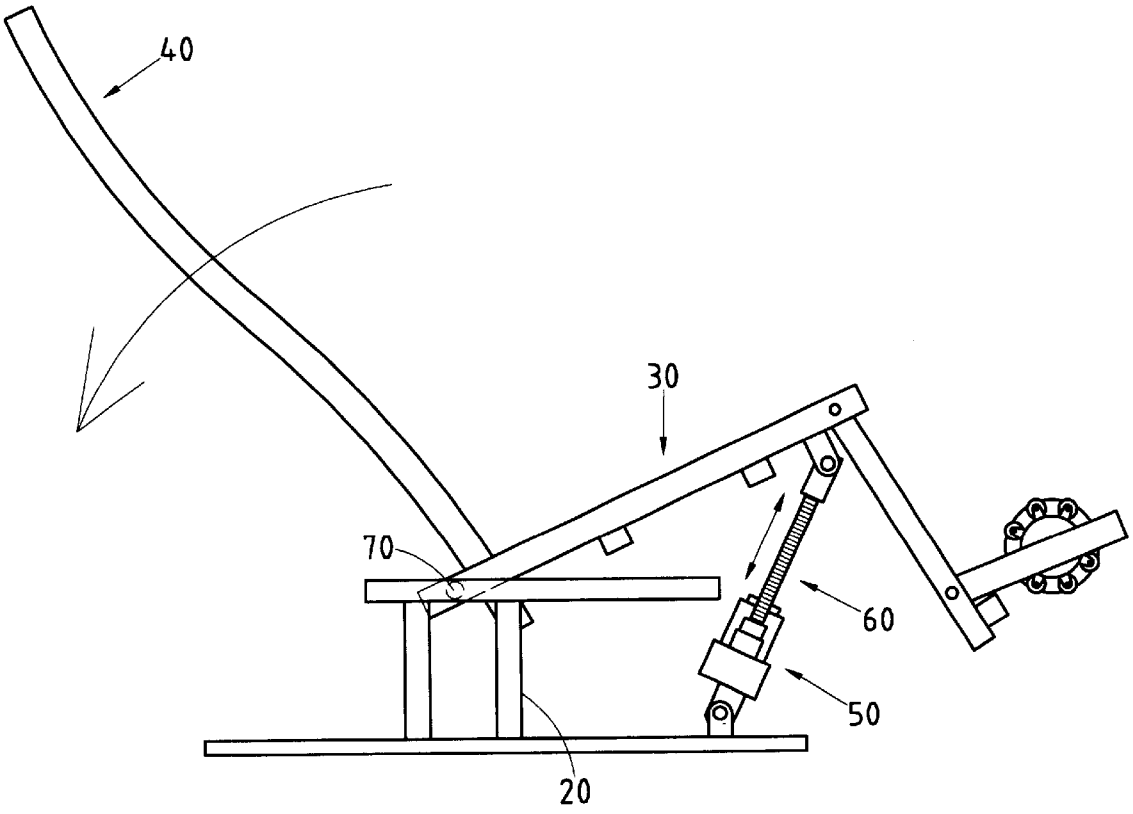
FIG. 9 shows another schematic view of the second preferred embodiment of the present invention at work.

As shown in FIG. 9, the seat frame 30 and the backrest frame 40 of the reclining chair of the present invention are linked by a single pivoting point 70.

In light of the seat frame 30 and the backrest frame 40 being engaged in the reclining motion synchronously, the spinal column and the thighbone of a person seated on the seat frame 30 form therebetween an angle corresponding to the angle that was formed between the spinal column and the thighbone of the person before the reclining action.

The present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A reclining chair comprising:

a base frame comprised of two horizontal slide rails and two inclined slide rails located under said two horizontal slide rails;

a seat frame comprised of two support rods and two support plates extending from said support rods, said support rods being provided at one end with a first slide wheel pivoted thereto, said support plates being provided at one end with a second slide wheel pivoted thereto, said first slide wheel being slidable on said horizontal slide rail said second slide wheel being slidable on said inclined slide rail; and a backrest frame fastened to one end of said seat frame such that said backrest frame and said seat frame form therebetween a predetermined angle, and such that said backrest frame and said seat frame recline synchronously.

2. The reclining chair as defined in claim 1, wherein said base frame is comprised of a drive device mounted thereon; wherein said seat frame and said base frame are linked by an expandable member whereby said expandable member is actuated by said drive device.

3. The reclining chair as defined in claim 2, wherein said drive device is comprised of a motor and a transmission member driven by said motor; wherein said expandable member is comprised of a threaded rod and a threaded tube fitted over said threaded rod whereby said threaded rod is actuated to engage in an expandable action in said threaded tube at such time when said transmission member is driven by said motor.

4. The reclining chair as defined in claim 2, wherein said seat frame and said backrest frame are linked by a single pivoting point.

5. The reclining chair as defined in claim 1, wherein said backrest frame is comprised of two lugs and is fastened to said seat frame such that said two lugs of said backrest frame are fastened to said seat frame in conjunction with two fastening bolts.

6. The reclining chair as defined in claim 5 wherein said backrest frame and said seat frame are connected with each other by a connection body.

* * * * *